US011464263B2

(12) United States Patent
Cardaci

(10) Patent No.: US 11,464,263 B2
(45) Date of Patent: Oct. 11, 2022

(54) SUPPORTIVE STRAPLESS BRA

(71) Applicant: Lynne Cardaci, Hampton Bays, NY (US)

(72) Inventor: Lynne Cardaci, Hampton Bays, NY (US)

( * ) Notice: Subject to any disclaimer, the term of this patent is extended or adjusted under 35 U.S.C. 154(b) by 0 days.

(21) Appl. No.: 14/545,169

(22) Filed: Apr. 2, 2015

(65) Prior Publication Data

US 2016/0286868 A1 Oct. 6, 2016

(51) Int. Cl.
*A41C 3/06* (2006.01)
*A41C 3/02* (2006.01)

(52) U.S. Cl.
CPC . *A41C 3/06* (2013.01); *A41C 3/02* (2013.01)

(58) Field of Classification Search
CPC .... A41C 3/02; A41C 3/06; A41C 3/08; A41C 3/007
USPC ..... 450/31, 39
See application file for complete search history.

(56) References Cited

U.S. PATENT DOCUMENTS 1,972,045 A * 8/1934 Julius ..... A41C 3/00 450/62
3,311,112 A * 3/1967 Murray ..... A41F 1/006 450/1
4,412,357 A * 11/1983 Mincher ..... A41D 13/0017 2/118
5,968,003 A * 10/1999 Sisson ..... A61F 13/145 602/53
6,272,761 B1 * 8/2001 Pechter ..... G01B 3/02 33/17 R
6,422,917 B1 * 7/2002 Rose ..... A41F 15/002 450/86
D465,637 S * 11/2002 Marco ..... D2/706
7,549,302 B2 6/2009 Duckham et al.
7,553,213 B2 6/2009 Smith et al.
7,677,952 B2 3/2010 Wooley
D655,069 S 3/2012 Lopez et al.
D709,670 S * 7/2014 Vericella ..... D2/708
D731,745 S * 6/2015 Maragni ..... D2/708
2003/0003844 A1 * 1/2003 Jones ..... A41C 3/00 450/88
2003/0236054 A1 * 12/2003 Chen ..... A41C 3/02 450/82
2004/0058618 A1 * 3/2004 Yang ..... A41C 3/0071 450/38
2005/0075048 A1 * 4/2005 Legaspi ..... A41C 3/10 450/41
2007/0123148 A1 * 5/2007 Heer ..... A41D 15/00 450/77
2009/0075562 A1 * 3/2009 Lung ..... A41C 3/0071 450/58
2011/0136406 A1 * 6/2011 Finocchiaro ..... A41C 3/0028 450/58
2012/0015586 A1 1/2012 Lopez et al.
2015/0313291 A1 * 11/2015 Jackson ..... A41C 3/065 450/88

* cited by examiner

*Primary Examiner* — Jocelyn Bravo
(74) *Attorney, Agent, or Firm* — Philip Weiss

(57) ABSTRACT

A supportive strapless bra that comprises two cups and a closing mechanism located on the side of either or both cups.

6 Claims, 3 Drawing Sheets

SUPPORTIVE STRAPLESS BRA

FIELD OF THE INVENTION

The present invention relates to a strapless bra which supports the breasts by having support on the side of the bra.

BACKGROUND OF THE INVENTION

In the prior art, strapless bras were designed without any support and therefore a woman with larger breasts could not wear a strapless bra.

U.S. D655069 relates to a strapless bra.

U.S. Pat. No. 7,553,213 relates to a convertible apparel top such as a bra, tank top or dress having two straps attached to the garment on at least one end of the strap with a swivel mechanism such as a means for attachment so that the garment may be converted from a garment with straps to a strapless garment and vice versa. In one embodiment, the end of the straps not attached with a swivel mechanism may be removably attached to the garment to facilitate the conversion and may be configured to attach both to the garment and to each other for multiple looks and configurations such as strapless, parallel straps, crisscross straps and a halter without the risk of losing the straps.

U.S. Pat. No. 7,677,952 relates to a strapless bra having winged support structures to maximize surface area of the bra to which an extended-wear adhesive is applied over substantially all of the undersurface of the bra.

U.S. Pat. No. 7,549,302 relates to a bra formed of a length of tubular knit material flattened into a double ply fabric having rounded top and bottom edges with ends secured to breast pockets to form a torso encircling main body portion. A pair of lengths of tubular knit material flattened into double ply fabrics have ends secured to the main body portion to form shoulder straps having rounded side edges.

U.S. Patent Publication No. 2012/0015586 relates to a front closure bra with crisscrossing straps. A bra comprising of a pair of breast cups a front opening closing connected to the breast cups, a pair of generally triangular side panels, each of the triangular side panels containing vertical boning connecting each of the triangular side panels to a different breast cup; a pair of crisscrossing straps, each crisscrossing strap coupled to the top of the vertical boning on one triangular side panel and the bottom of the boning on an opposite triangular side panel.

SUMMARY OF THE INVENTION

The present invention relates to a supportive strapless bra. It is an object of the present invention to provide a strapless bra for woman of larger bust sizes.

It is an object of the present invention to the bra to be designed as a bandeau bra, wherein only one band wraps around the back and has a one sided hook and eye area in an area under the armpit, the once closed, naturally lifts and supports the bosom.

It is an object of the present invention for a bra to have a crisscross in the back that adds more support and further has hook and eye closures that are placed on each side of the breast which lifts and supports the breast and prevents the breast from drooping in the front like typical strapless bras in the prior art.

It is an object of the present invention for the cups to have under wiring.

It is an object of the present invention for the bra to have no under wiring and for the bra to be molded to bras which have smaller cups.

It is an object of the present invention for the bra to have side support.

It is an object of the present invention for the side support to be additional plastic on one or both sides of the bra.

It is an object of the present invention to have no mechanism for opening and closing the bra in the front of the bra between the cups.

It is an object of the present invention for the closure mechanism of the bra to be behind the nipple line so that the bra will pull on the breast to provide support.

It is an object of the present invention for the closure mechanism to be on one side of the bra.

It is an object of the present invention for the closure mechanism to be on both sides of the bra.

It is an object of the present invention for the closure mechanisms to include a snap, hook, Velcro, adhesive or glue.

It is an object of the present invention for the bra to be made of one continuous piece of material.

It is an object of the present invention for the bra to be made of two separate pieces of material that are joined together.

It is an object of the present invention for the bra to be adjustable.

It is an object of the present invention for the bra to be a bandeau, one piece wrap.

It is an object of the present invention for the bra to have a crisscross back with a hole that one can clip on.

It is an object of the present invention for the bra to have a halter conversion.

It is an object of the present invention for the concept of the bra to be used in a bathing suit top.

BRIEF DESCRIPTION OF THE INVENTION

DETAILED DESCRIPTION OF THE INVENTION

Figure 1:
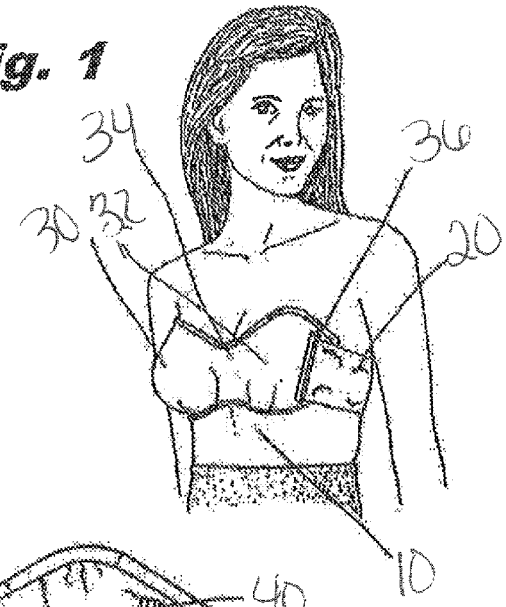
FIG. 1 is a front view of the embodiment of the invention worn around a person's breasts.

FIG. 1 shows front view of bra 10 having a side strap 20, having cups 30, 32 with a solid bridge 34 between the two cups, also having closure mechanism 36 which fastens to the side of the breast where cup 32 is located.

Figure 2:
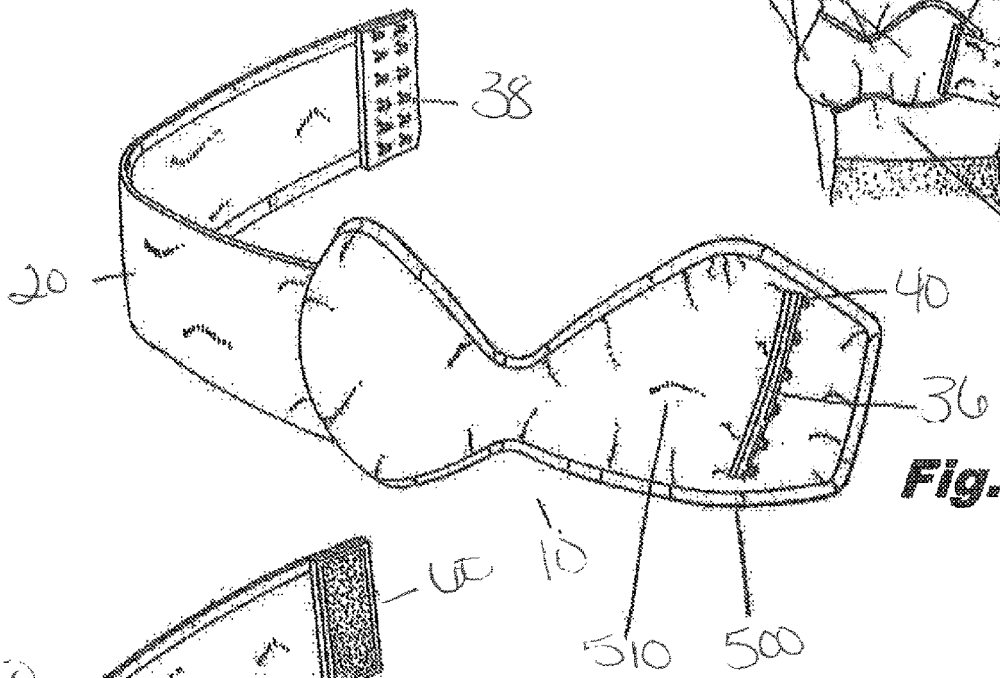
FIG. 2 is a front view of the embodiment in an open state.

FIG. 2 shows a front view of bra 10 having strap 20 and hooks 38 which attach to the eye 40 of closure mechanism 36 having an underwire 500 wherein said closure mechanism 36 is located behind nipple line 510 shown in the embodiment in FIG. 2.

Figure 3:
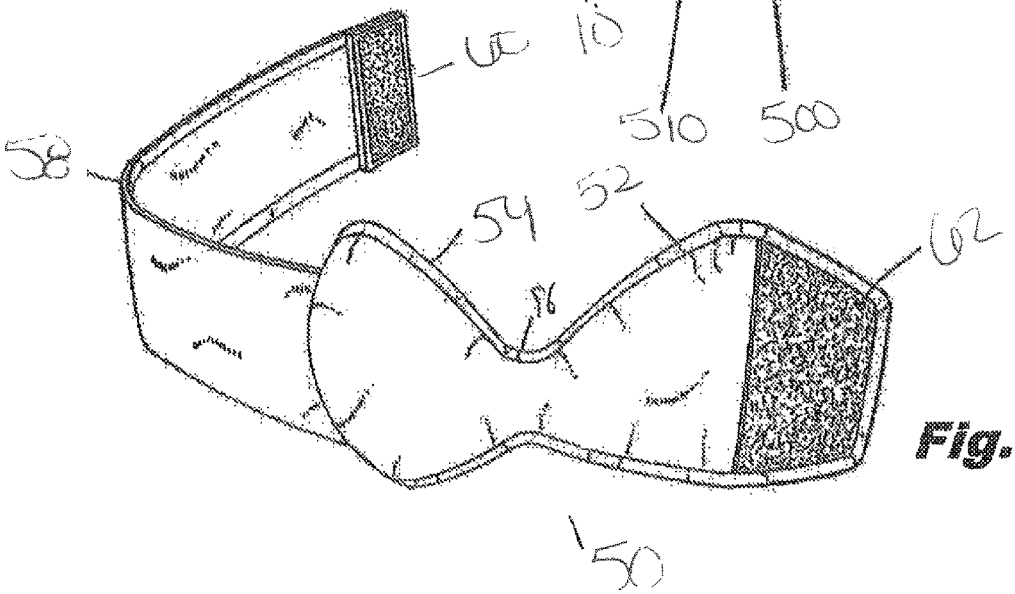
FIG. 3 is a front view of the embodiment in an open state.

FIG. 3 shows bra 50 having cups 52, 54 with a solid bridge 56 between the two cups, also having strap 58, with a Velcro 60 closure at the end of the strap 62 which attaches to the Velcro at the end of the cup 52.

Figure 4:
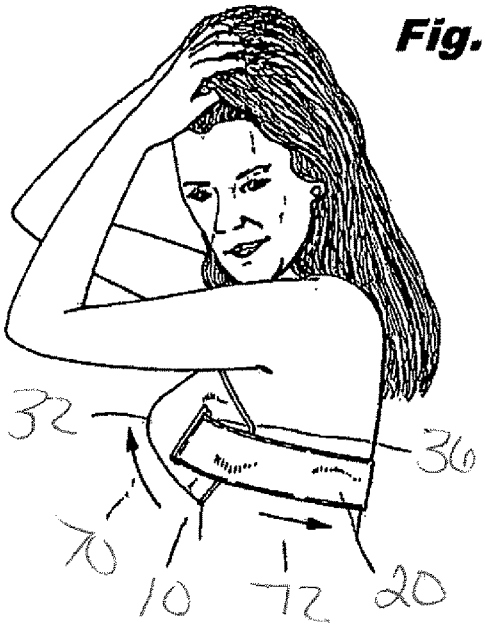
FIG. 4 is a side view of the embodiment worn around a person's breasts.

FIG. 4 shows side view of bra 10 showing the strap 20, attached to cup 32 with closing mechanism 36. Arrows 70 and 72 show the support action caused by the bra 10 wherein the bra pulls the breast back towards the bottom and also lifts them up because of the location of the closing mechanism 36.

Figure 5:
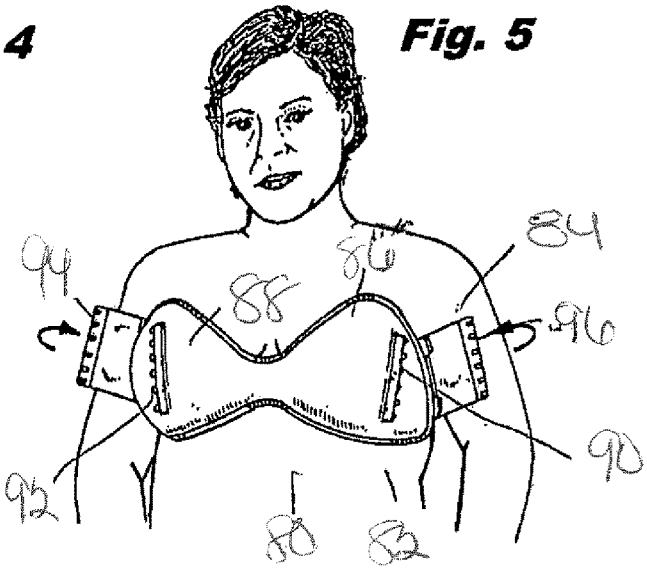
FIG. 5 is front view of the embodiment in the open position around a woman.

FIG. 5 shows front view of bra 80 having two pieces 82 and 84, piece 82 has the cups 86 and 88 for supporting the breasts. Section 82 has the closing mechanism eyes which are 90 and 92 and piece 84 has hooks 94 and 96 to attach to eyes 90 and 92.

Figure 6:
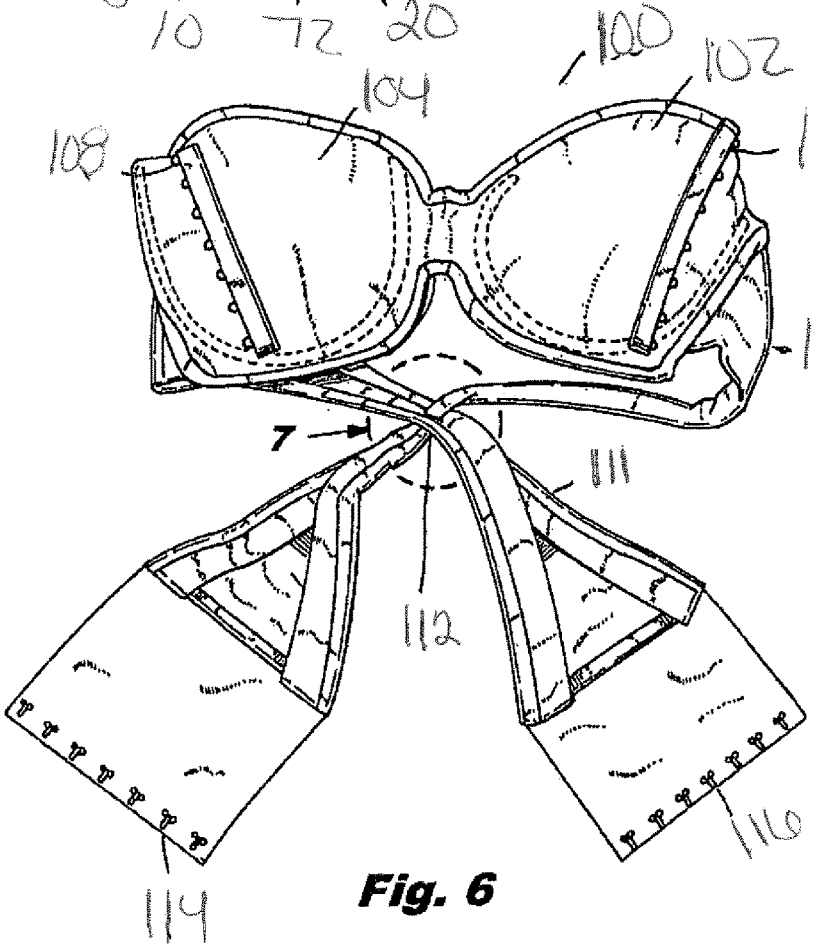
FIG. 6 is a full view of an embodiment showing the crisscross version of the bra.

FIG. 6 shows bra 100, having cups 102, 104, a closing mechanism with eyes 106 on cup 102 and a closing mechanism 108 on cup 104. The strap 110 which comes off of cup 102 is put through a crisscross mechanism 112 and goes through a hole in strap 111 and then has hooks for the closing mechanism 114 which hooks to eyes 108 and 116 hooks to eyes 106. The straps are adjustable due to the crisscross mechanism 112 which can then loosen and tighten the bra around the body.

Figure 7:
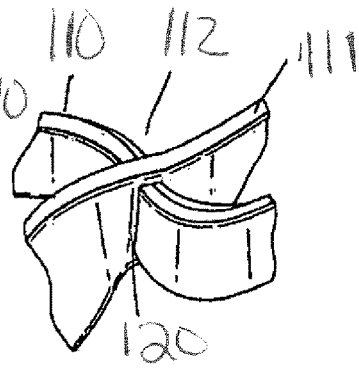
FIG. 7 is showing the cross sectional view of FIG. 6.

FIG. 7 shows a cross section of the crisscross mechanism 112 wherein the strap 110 goes through a hole 120 located in strap 111.

Figure 8:
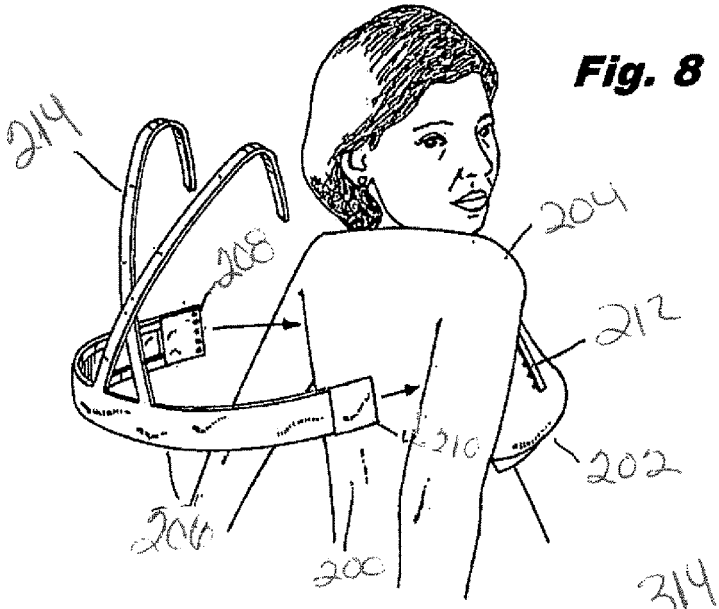
FIG. 8 is a back view of an embodiment further comprising crisscross straps.

FIG. 8 shows bra 200 showing a cup 202 and a cup 204 not shown; having a strap 206 with hooks 208, 210, with hook 210 attaching to eyes 212 found on cup 202; having crisscross shoulder straps 214.

Figure 9:
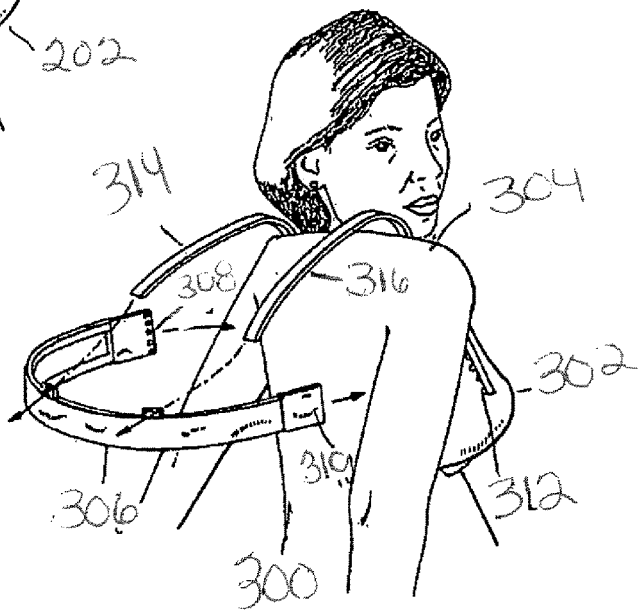
FIG. 9 is a back view of an embodiment further comprising straps.

FIG. 9 shows bra 300 showing a cup 302 and a cup 304 not shown; having a strap 306 with hooks 308, 310, with hook 310 attaching to eyes 312 found on cup 302; having shoulder straps 314, 316.

Figure 10:
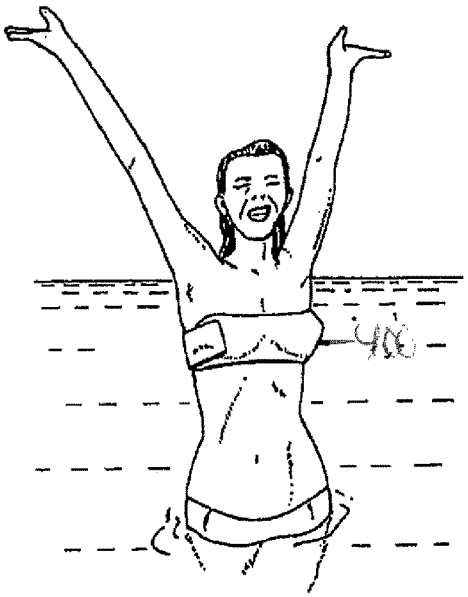
FIG. 10 is the bathing suit version of the present invention.

FIG. 10 shows bra 400 used as a bathing suit.

The invention claimed is:

1. A supportive strapless bra comprising:

two cups and a bridge between said two cups;

wherein said two cups each include a respective underwire, each underwire having a medial end and a lateral end;

two closure mechanisms wherein each closure mechanism is directly attached to an outer surface of a respective cup of said two cups and comprises a plurality of eyes;

a band having a first end and a second end, each of the first end and the second end having a plurality of hooks, wherein the band is configured to be removably attached to the two cups by removably attaching the respective plurality of hooks on each end of the band to the respective plurality of eyes on each cup;

wherein each closure mechanism extends along a central portion of the respective cup directly adjacent to an apex of the respective cup, such that at least a portion of each closure mechanism is interposed between the medial end and the lateral end of the respective underwire; and wherein, when the band is attached to the two cups, the bra is configured to completely encircle a torso of a wearer, and the band is configured to provide a lateral pull on each cup so as to provide support to breasts of the wearer.

2. The bra of claim 1 wherein said bra is configured to be used for bust sizes of C cup or larger.

3. The bra of claim 1 wherein said bra, once closed, is configured to lift and support the breasts of the wearer.

4. The bra of claim 1 wherein said bra has additional plastic on one or both sides of said bra for additional side support.

5. The bra of claim 1 wherein said bra has no mechanism for opening and closing said bra in front of said bra between said cups.

6. The bra of claim 1 wherein said bra is configured to be used as a bathing suit top.

* * * * *